US011284197B2

(12) United States Patent
Shan et al.

(10) Patent No.: US 11,284,197 B2
(45) Date of Patent: Mar. 22, 2022

(54) VIBRATION COMPONENT, SPEAKER AND ELECTRONIC DEVICE

(71) Applicant: BEIJING XIAOMI MOBILE SOFTWARE CO., LTD., Beijing (CN)

(72) Inventors: Lianwen Shan, Beijing (CN); Jishuang Ma, Beijing (CN); Yu Zhang, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/145,323

(22) Filed: Jan. 9, 2021

(65) Prior Publication Data

US 2021/0385581 A1 Dec. 9, 2021

(30) Foreign Application Priority Data

Jun. 9, 2020 (CN) ..... 202010518978.2

(51) Int. Cl.
*H04R 9/02* (2006.01)
*H04R 7/12* (2006.01)

(52) U.S. Cl.
CPC ..... *H04R 9/022* (2013.01); *H04R 7/127* (2013.01); *H04R 2307/025* (2013.01)

(58) Field of Classification Search
CPC .... H04R 7/122; H04R 7/125; H04R 2207/00; H04R 2207/021; H04R 2231/00; H04R 2231/001; H04R 2231/003; H04R 9/022; H04R 7/127; H04R 2307/025; H04R 7/02; H04R 7/04; H04R 7/06; H04R 7/10; H04R 2307/027; H04R 2307/204
See application file for complete search history.

(56) References Cited

U.S. PATENT DOCUMENTS 4,129,195 A * 12/1978 Ishii ..... H04R 7/02 181/167
2017/0353801 A1 12/2017 Li et al.
2018/0035212 A1* 2/2018 Shao ..... H04R 7/06
2018/0109893 A1* 4/2018 Chu ..... H04R 7/16

FOREIGN PATENT DOCUMENTS

CN 109257684 A 1/2019
CN 111065028 A 4/2020
CN 111131971 A 5/2020
WO 2020093548 A1 5/2020

OTHER PUBLICATIONS

European Patent Office, Extended European Search Report Issued in Application No. 21152017.6, dated Jun. 18, 2021, Germany, 7 pages.

* cited by examiner

*Primary Examiner* — Mark Fischer
(74) *Attorney, Agent, or Firm* — Syncoda LLC; Feng Ma

(57) ABSTRACT

A vibration component includes a dome, a diaphragm, and a voice coil. The dome includes a porous heat dissipation layer, the diaphragm partially covers a portion of a surface of the dome, and the voice coil is connected with a side of the dome facing away from the diaphragm.

19 Claims, 9 Drawing Sheets

VIBRATION COMPONENT, SPEAKER AND ELECTRONIC DEVICE

CROSS-REFERENCE TO RELATED APPLICATION

This application claims priority to Chinese Patent Application No. 202010518978.2 filed on Jun. 9, 2020, the disclosure of which is hereby incorporated by reference in its entirely.

BACKGROUND

Electronic devices such as mobile phones, tablet computers, and smart sound-boxes all include speakers, which give these electronic devices an ability to play audio. A speaker includes a diaphragm and a voice coil which drives the diaphragm to vibrate to produce sound. However, the voice coil generates heat during its operation, and when the heat is not dissipated in time, it may affect the normal operation of the voice coil and the diaphragm.

SUMMARY

Various embodiments of the present disclosure provide a vibration component, a speaker and an electronic device.

An aspect of the present disclosure provides a vibration component, including:

a dome including a porous heat dissipation layer;

a diaphragm partially covering a portion of a surface of the dome; and a voice coil connected with a side of the dome facing away from the diaphragm.

Another aspect of the present disclosure provides a speaker, including the vibration component described above.

Another aspect of the present disclosure provides an electronic device, including the speaker described above.

DETAILED DESCRIPTION

Figure 1:
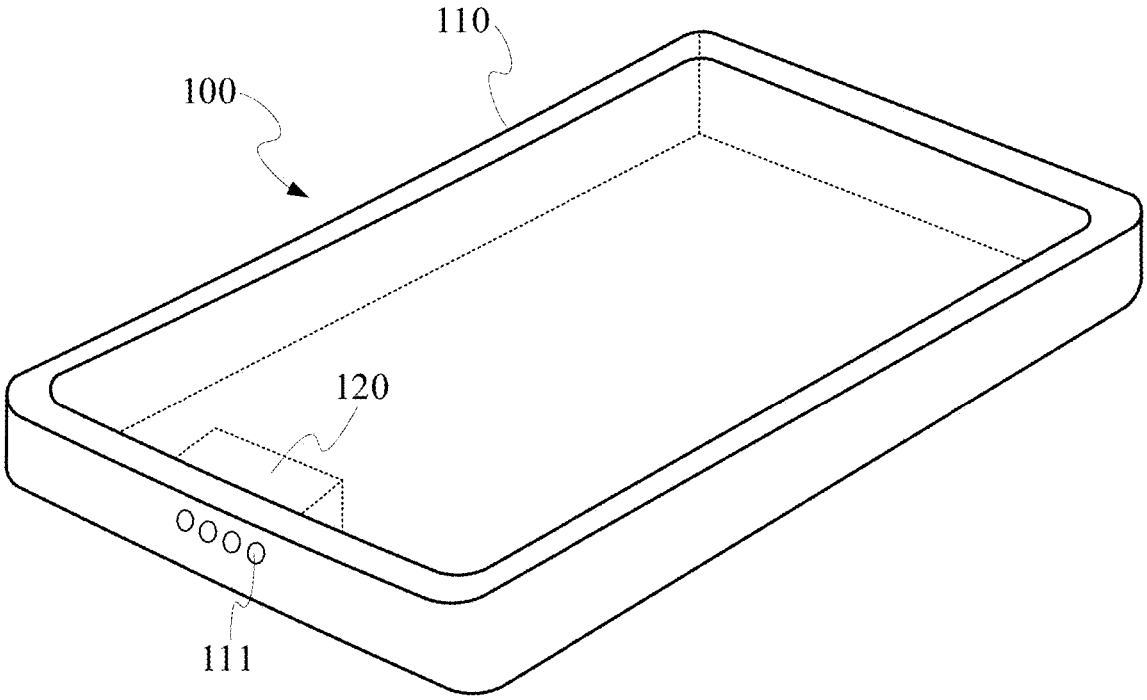
FIG. 1 is a schematic structural diagram illustrating an electronic device according to some embodiments of the present disclosure.

Examples will be described in detail herein, with the illustrations thereof represented in the drawings. When the following descriptions involve the drawings, like numerals in different drawings refer to like or similar elements unless otherwise indicated. The embodiments described in the following examples do not represent all embodiments consistent with the present disclosure. Rather, they are merely examples of apparatuses and methods consistent with some aspects of the present disclosure as detailed in the appended claims.

The terms used in the present disclosure are for the purpose of describing particular examples only, and are not intended to limit the present disclosure. The technical terms or scientific terms used in the present disclosure shall have the general meanings understood by those of ordinary skill in the art to which the present disclosure belongs, unless otherwise defined. Terms "first", "second" and the like used in the present disclosure and the appended claims do not indicate any order, quantity or importance, but are only used to distinguish different components. Likewise, terms "one" or "a" and the like do not indicate a limitation on the quantity, but indicate at least one. Unless otherwise indicated, terms "include" or "comprise" and the like mean that the elements or items before "include" or "comprise" cover the elements or items listed after "include" or "comprise" and their equivalents, and other elements or items are not excluded. Terms "connect" or "couple" and the like are not limited to physical or mechanical connections, and may include electrical connections, whether direct or indirect.

Terms determined by "a", "the" and "said" in their singular forms in the present disclosure and the appended claims are also intended to include plurality or multiple, unless clearly indicated otherwise in the context. It should also be understood that the term "and/or" as used herein is and includes any or all possible combinations of one or more of the associated listed items.

Typically, a speaker includes a vibration component, which includes a dome, a diaphragm, and a voice coil. The dome covers a surface of the diaphragm, a side of the diaphragm facing away from the dome is connected with the voice coil, and a sound cavity is formed between a side of the diaphragm facing the voice coil and a bracket of the speaker. The dome is provided to reinforce the diaphragm, so that the diaphragm may not undergo split vibration when the voice coil vibrates at a high frequency, thereby ensuring sound quality. However, the dome includes a foamed polymer material which has a poor heat conduction performance, so the heat generated from the voice coil may be enclosed in the sound cavity of the diaphragm facing the voice coil, and may not be easily dissipated through the dome. When the temperature of the voice coil reaches a preset threshold, the power output from a power amplifier to the voice coil may be decreased. Moreover, when the temperature inside the speaker increases, the material of the diaphragm may become softer and the resonance frequency of the diaphragm may be decreased. In view of this, when the heat generated from the vibration component is not easily dissipated, it is not advantageous to a long-term normal operation of the voice coil and the diaphragm, and the acoustic performance of the speaker is affected.

Embodiments of the present disclosure provide a vibration component, a speaker and an electronic device, which will be described in detail below in conjunction with the accompanying drawings.

The electronic device according to an embodiment of the present disclosure includes, but is not limited to, a mobile phone, a tablet computer, an iPad, a digital broadcast terminal, a messaging device, a game console, a medical equipment, a fitness equipment, a PDA (Personal Digital Assistant), a smart wearable device, a smart TV, a cleaning robot, a smart sound-box, etc.

FIG. 1 is a schematic structural diagram illustrating an electronic device according to some embodiments of the present disclosure. With reference to FIG. 1, the electronic device 100 includes a main body 110 and a speaker 120. The main body 110 is formed with an installation cavity and a sound conduction hole 111 communicated with the installation cavity. The speaker 120 and other components are assembled in the installation cavity, and the speaker 120 conducts the sound through the sound conduction hole 111.

In some embodiments, the main body 110 includes a middle bezel, a rear cover, and a display panel. The middle bezel includes a front face and a back face opposite to the front face. The display panel is assembled on the front face of the middle bezel, and the rear cover is assembled on the back face of the middle bezel. The middle bezel, the rear cover and the display panel cooperate to form the installation cavity of the main body 110. The sound conduction hole 111 may be provided in the middle bezel.

The display panel can include a display screen, such as a liquid-crystal display (LCD) screen, a light-emitting diode (LED) display screen, or an organic light-emitting diode (OLED) display screen.

In some embodiments, the speaker 120 may be disposed close to the display panel of the electronic device 100. In some embodiments, the speaker 120 may be disposed close to the rear cover of the electronic device 100. In some embodiments, the speaker 120 may be disposed on the top and/or bottom of the electronic device 100. In some embodiments, the speaker 120 may be disposed in the middle of the electronic device 100. The position where the speaker 120 is disposed is not particularly limited in the present disclosure.

Figure 2:
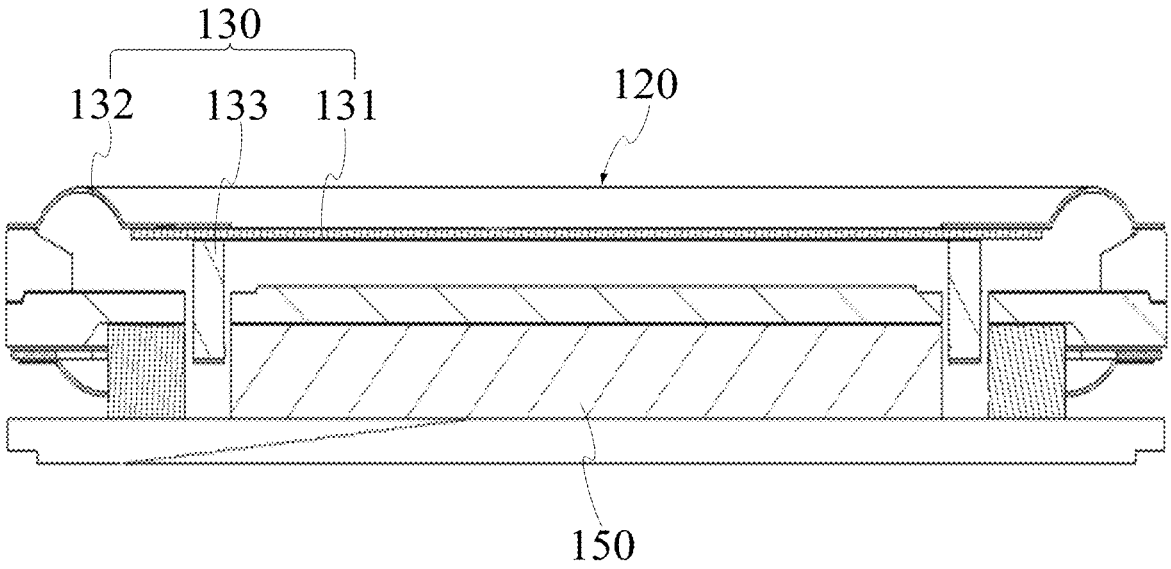
FIG. 2 is a cross-sectional view illustrating a partial structure of a speaker according to some embodiments of the present disclosure.
Figure 3:
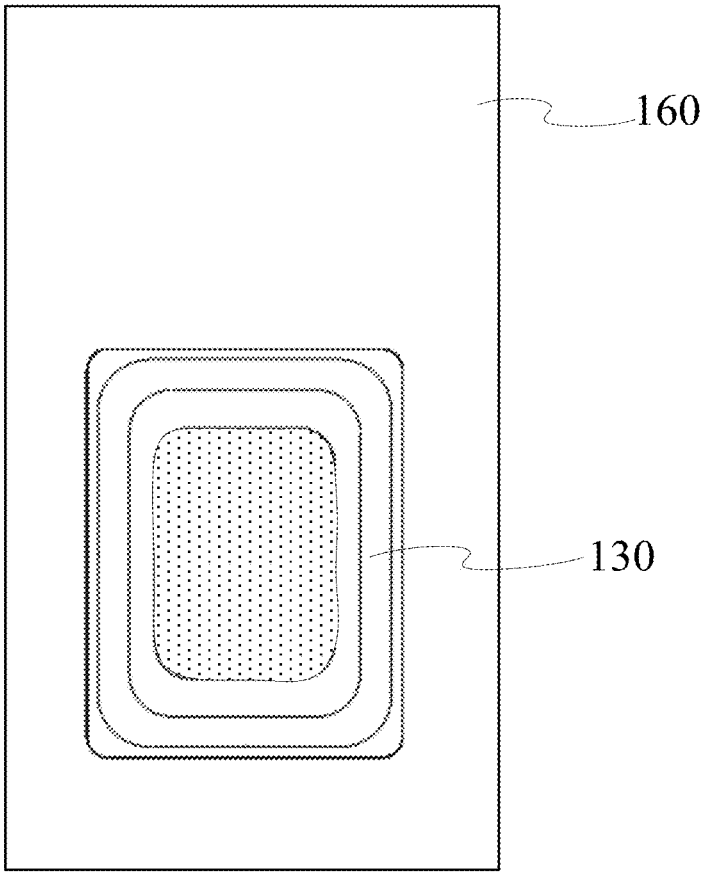
FIG. 3 is a plan view illustrating a speaker according to some embodiments of the present disclosure.

FIG. 2 is a cross-sectional view illustrating a partial structure of the speaker 120 according to some embodiments of the present disclosure. FIG. 3 is a plan view illustrating the speaker 120 according to some embodiments of the present disclosure. With reference to FIG. 2 and FIG. 3, the speaker 120 includes a vibration component 130, a magnetic circuit component 150 and a bracket 160. The magnetic circuit component 150 provides a magnetic field for the vibration component 130. The vibration component 130 and the magnetic circuit component 150 are assembled in the bracket 160, and then the bracket 160 is assembled in the installation cavity of the electronic device 100.

Figure 4:
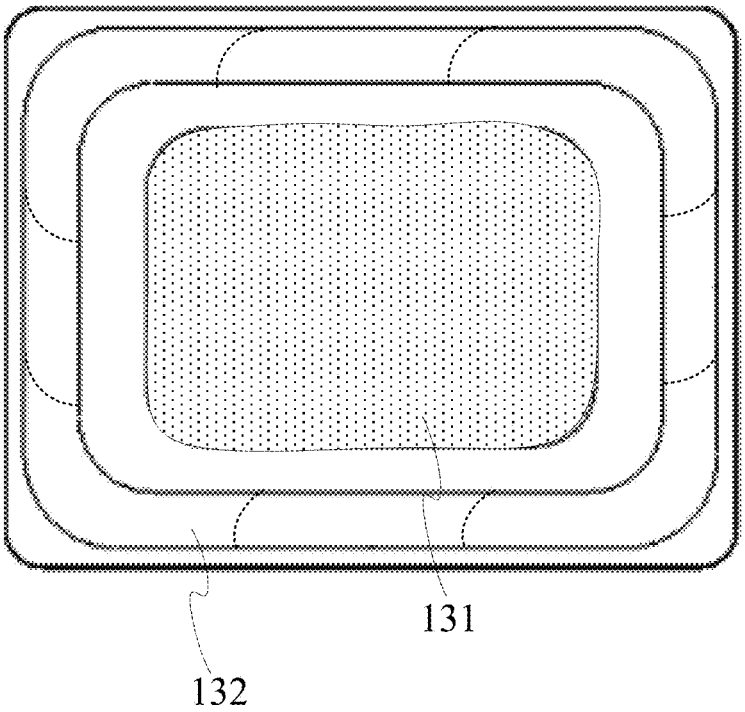
FIG. 4 is a schematic diagram illustrating a partial structure of a vibration component according to some embodiments of the present disclosure.
Figure 5:
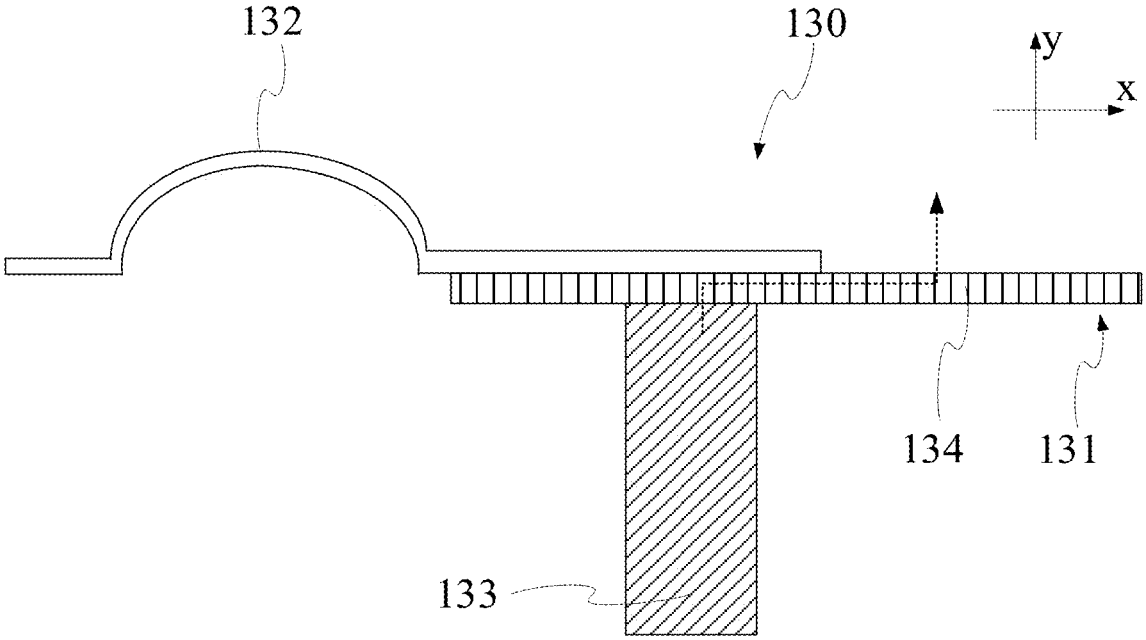
FIG. 5 is a cross-sectional view illustrating a partial structure of a vibration component according to some embodiments of the present disclosure.

FIG. 4 is a schematic diagram illustrating a partial structure of the vibration component 130 according to some embodiments of the present disclosure. FIG. 5 is a cross-sectional view illustrating a partial structure of the vibration component 130 according to some embodiments of the present disclosure. With reference to FIG. 2, FIG. 4 and FIG. 5, the vibration component 130 includes a dome 131, a diaphragm 132 and a voice coil 133.

The dome 131 includes a porous heat dissipation layer 134, which gives the dome 131 a good heat dissipation performance.

The diaphragm 132 partially covers a portion of a surface of the dome 131. In some embodiments, with reference to FIG. 4, the diaphragm 132 may have an annular structure, and the dome 131 is provided in the middle area of the diaphragm 132. In this way, the diaphragm 132 may not completely cover the dome 131, which is beneficial to reduce the weight of the vibration component 130, and also facilitates heat dissipation from an area of the dome 131 that is not covered by the diaphragm 132.

The voice coil 133 is connected with a side of the dome 131 facing away from the diaphragm 132. Compared with the case in which the voice coil 133 is connected with the diaphragm 132, the heat generated from the voice coil 133 can be directly dissipated through the dome 131, reducing heat dissipation through the diaphragm 132. This prevents the diaphragm 132 from softening due to higher temperature and ensures the vibration performance of the diaphragm 132.

Based on the above, the dome 131 includes the porous heat dissipation layer 134, which gives the dome 131 a good heat dissipation capability. By connecting the voice coil 133 with the side of the dome 131 facing away from the diaphragm 132, the heat generated from the voice coil 133 can be directly transferred to the dome 131, reducing heat transfer through the diaphragm 132. By making the diaphragm 132 partially cover a portion of the surface of the dome 131, the heat generated from the voice coil 133 can be dissipated through the area of the dome 131 that is not covered by the diaphragm 132, i.e., the heat can be dissipated in a direction shown by the arrow in FIG. 5, which effectively solves the heat dissipation problem of the vibration component 130 and ensures the normal operation of the voice coil 133 and the diaphragm 132, and in turn facilitates a long-term operation of the vibration component 130 and the speaker 120, ensuring the acoustic performance of the speaker 120 and the electronic device 100 and improving the user experience.

In an embodiment of the present disclosure, the porous heat dissipation layer 134 may include a plurality of heat dissipation holes for heat dissipation. Regarding the arrangement of the heat dissipation holes, the present disclosure provides the following embodiment.

Figure 6:
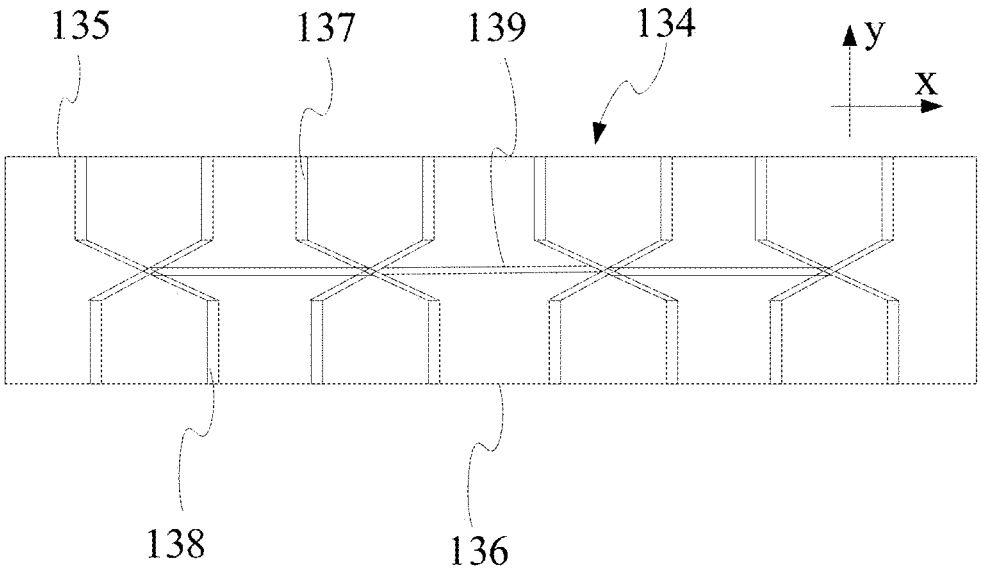
FIG. 6 is a cross-sectional view illustrating a partial structure of a porous heat dissipation layer according to some embodiments of the present disclosure.

FIG. 6 is a cross-sectional view illustrating a partial structure of the porous heat dissipation layer 134 according to some embodiments of the present disclosure. In some embodiments, with reference to FIG. 6, the porous heat dissipation layer 134 may include a first heat dissipation surface 135 and a second heat dissipation surface 136 opposite to the first heat dissipation surface 135, and the second heat dissipation surface 136 is closer to the voice coil 133 than the first heat dissipation surface 135. The porous heat dissipation layer 134 may include a first heat dissipation hole 137, a second heat dissipation hole 138, and a third heat dissipation hole 139 that are alternately connected, the first heat dissipation hole 137 may be connected to the first heat dissipation surface 135, the second heat dissipation hole 138 may be connected to the second heat dissipation surface 136, the third heat dissipation hole 139 may be arranged transversely, and the third heat dissipation hole 139 may be connected between the first heat dissipation hole 137 and the second heat dissipation hole 138.

Based on the above, the heat generated from the voice coil 133 may enter the porous heat dissipation layer 134 through the second heat dissipation hole 138, be diffused to the first heat dissipation hole 137 from the third heat dissipation hole 139, and then be transferred to the outside from the first heat dissipation hole 137, so that the heat may be dissipated in a longitudinal direction (y-axis direction) from the voice coil 133 to the porous heat dissipation layer 134, in a transverse direction (x-axis direction) of the porous heat dissipation layer 134, and in the longitudinal direction (y-axis direction) from the porous heat dissipation layer 134 to the outside.

It should be noted that FIG. 6 is merely an example, and the first heat dissipation hole 137, the second heat dissipation hole 138, and the third heat dissipation hole 139 may also be arranged in the porous heat dissipation layer 134 in other regular or irregular manners. In some embodiments, the first heat dissipation hole 137, the second heat dissipation hole 138, and the third heat dissipation hole 139 may be regular heat dissipation holes. For example, the first heat dissipation hole 137, the second heat dissipation hole 138, and the third heat dissipation hole 139 may be cylinder-shaped holes, regular-prism-shaped holes, truncated-cone-shaped holes, etc. In some embodiments, the first heat dissipation hole 137, the second heat dissipation hole 138, and the third heat dissipation hole 139 may be heat dissipation holes with irregular structures. The third heat dissipation hole 139 may be arranged in the porous heat dissipation layer 134 in parallel to the second heat dissipation surface 136, to allow heat to be transferred in the transverse direction. The first heat dissipation hole 137 and the second heat dissipation hole 138 may be arranged in the porous heat dissipation layer 134 perpendicularly to the first heat dissipation surface 135 and the second heat dissipation surface 136 respectively, to allow heat to be transferred in the longitudinal direction.

The porous heat dissipation layer 134 may be processed in a variety of ways. Regarding the structure of the porous heat dissipation layer 134, two kinds of embodiments are provided below.

In the first kind of embodiments, the porous heat dissipation layer 134 may be a metal plate, and a plurality of heat dissipation holes may be processed on the metal plate by machining. For the structure of the heat dissipation holes, reference may be made to the related descriptions of the first heat dissipation hole 137, the second heat dissipation hole 138, and the third heat dissipation hole 139.

In the second kind of embodiments, the porous heat dissipation layer 134 may include a foamed metal material. Since the porous heat dissipation layer 134 is made of a metal material, heat can also be dissipated through metal, which gives the porous heat dissipation layer 134 good heat conduction and heat dissipation performances.

Figure 7:
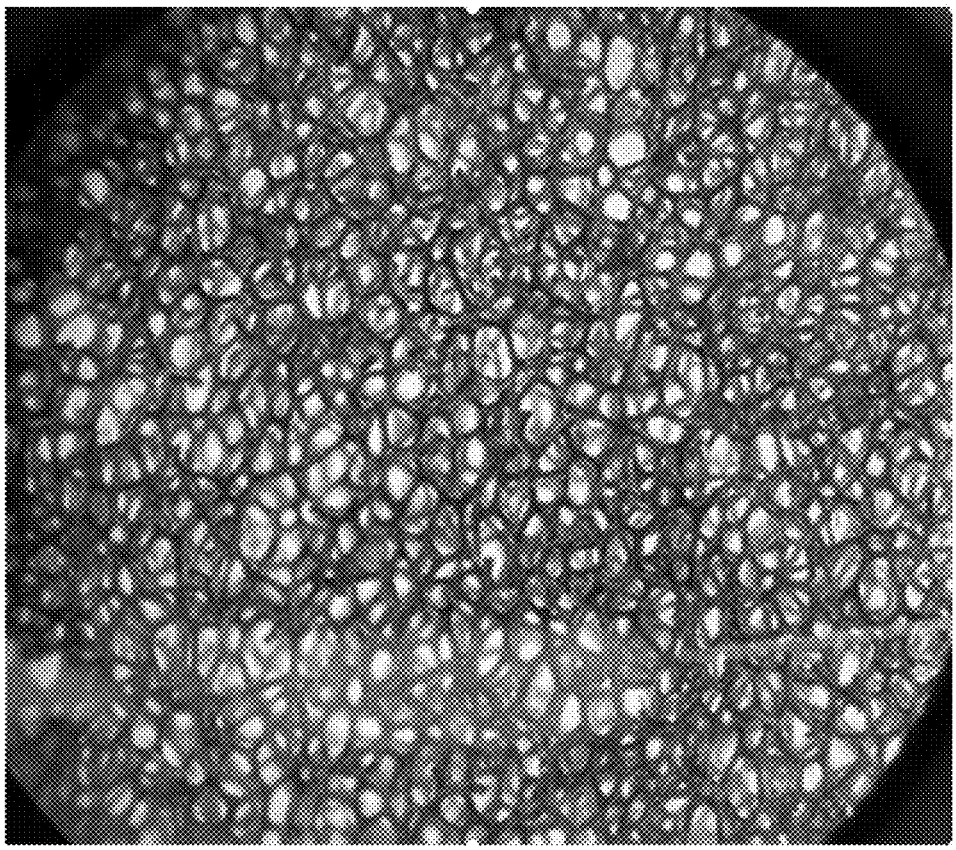
FIG. 7 is a morphology diagram illustrating foamed copper under a microscope according to some embodiments of the present disclosure.

In some embodiments, the foamed metal material may include foamed copper or foamed aluminum. Preferably, the porous heat dissipation layer 134 includes foamed copper. Referring to FIG. 7, which is a morphology diagram illustrating the foamed copper under a microscope according to some embodiments of the present disclosure, copper wires are wound around each other, and a large number of heat dissipation holes that are alternately communicated are distributed in the foamed copper. The foamed copper has a porosity of 96%-98% with a relatively low volume density and a relatively large specific surface area, which gives the dome 131 a good heat dissipation performance and a light weight.

Figure 8:
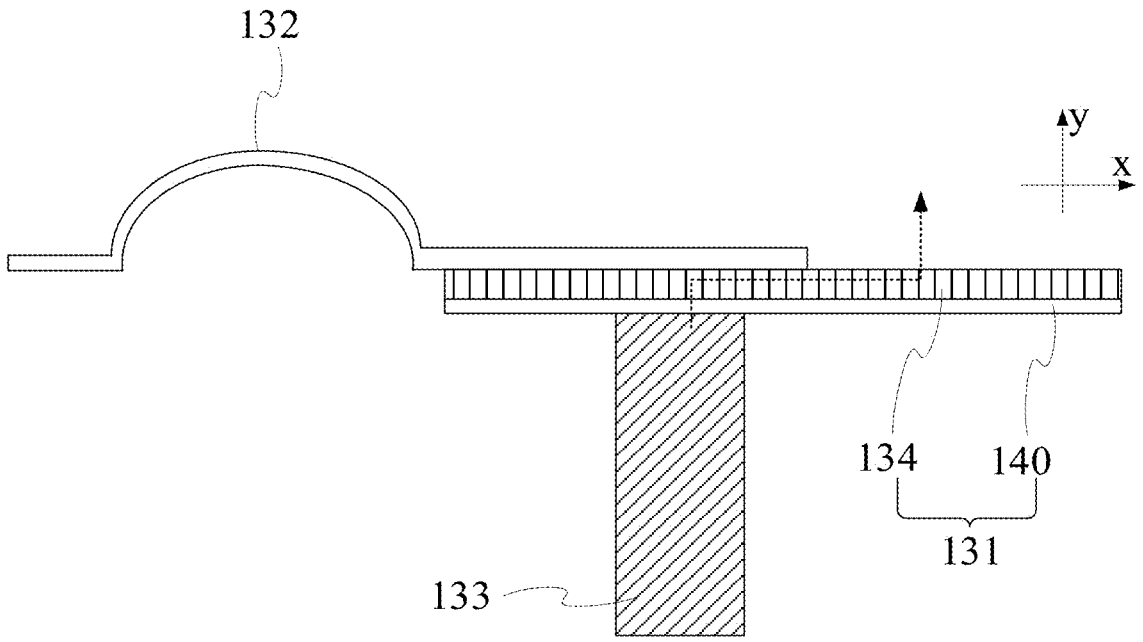
FIG. 8 is a cross-sectional view illustrating a partial structure of a dome according to some embodiments of the present disclosure.

FIG. 8 is a cross-sectional view illustrating a partial structure of the dome 131 according to some embodiments of the present disclosure. In some embodiments, with reference to FIG. 8, the dome 131 may further include a first support layer 140 provided between the porous heat dissipation layer 134 and the voice coil 133 to support the porous heat dissipation layer 134. When the porous heat dissipation layer 134 includes a foamed metal material, the hardness of the foamed metal material is relatively low, which is not advantageous to improve the mechanical strength of the dome 131. The first support layer 140 takes a support effect on the porous heat dissipation layer 134, giving the dome 131 a good mechanical strength. The first support layer 140 may also prevent heat from flowing back to the first support layer 140 from the porous heat dissipation layer 134 and entering the sound cavity where the voice coil 133 is located.

In some embodiments, the first support layer 140 may include a first metal layer. The first metal layer may be a metal sheet such as a copper foil or an aluminum foil. This metal sheet may be easily obtained and have good support and heat conduction effects, which gives the dome 131 good mechanical strength and heat conduction effect, and facilitates the heat generated from the voice coil 133 to be dissipated.

Figure 9:
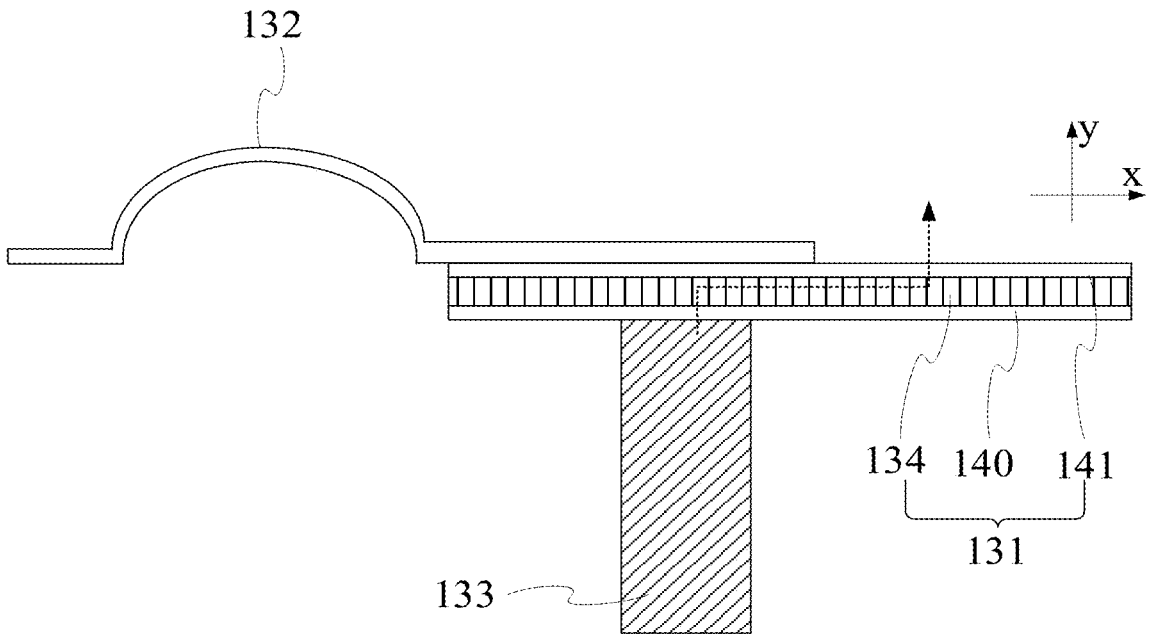
FIG. 9 is a cross-sectional view illustrating a partial structure of a dome according to some embodiments of the present disclosure.

FIG. 9 is a cross-sectional view illustrating a partial structure of the dome 131 according to some embodiments of the present disclosure. In some embodiments, with reference to FIG. 9, the dome 131 may further include a second support layer 141 provided on a side of the porous heat dissipation layer 134 facing away from the first support layer 140 to support the porous heat dissipation layer 134 in corporation with the first support layer 140. The first support layer 140 and the second support layer 141 may cooperate to give the dome 131 a good mechanical strength. Both of the first support layer 140 and the second support layer 141 have a heat conduction capability, which facilitates the dome 131 to dissipate the heat generated from the voice coil 133.

In some embodiments, the second support layer 141 may include a second metal layer. The second metal layer may be a metal sheet such as a copper foil or an aluminum foil. This metal sheet may be easily obtained and have good support and heat conduction effects.

Based on the above, the heat generated from the voice coil 133 may be dissipated outward through the dome 131, but the heat is inevitably dissipated through the diaphragm 132. In view of this, in some embodiments, referring to FIG. 10, which is a cross-sectional view illustrating a partial structure of the vibration component 130 according to some embodiments of the present disclosure, the diaphragm 132 may include a diaphragm body 142 and a heat insulation layer 143 provided between the diaphragm body 142 and the dome 131. In this way, after the heat generated from the voice coil 133 is transferred to the dome 131, due to the restriction of the heat insulation layer 143, the heat is first transferred transversely along the dome 131, then transferred in the longitudinal direction in the area of the dome 131 that is not covered by the diaphragm 132, and finally dissipated through the area of the dome 131 that is not covered by the diaphragm 132 (as shown by the arrow in FIG. 10), which ensures effective heat dissipation from the vibration component 130, and prevents the heat generated from the voice coil 133 from being directly transferred to the diaphragm 132 from the dome 131 to affect the vibration performance of the diaphragm 132, thereby ensuring the sound quality of the speaker 120.

In some embodiments, the heat insulation layer 143 may be formed by coating the diaphragm body 142 with a heat insulation material. In some embodiments, the heat insulation material may include a heat insulation adhesive.

Figure 10:
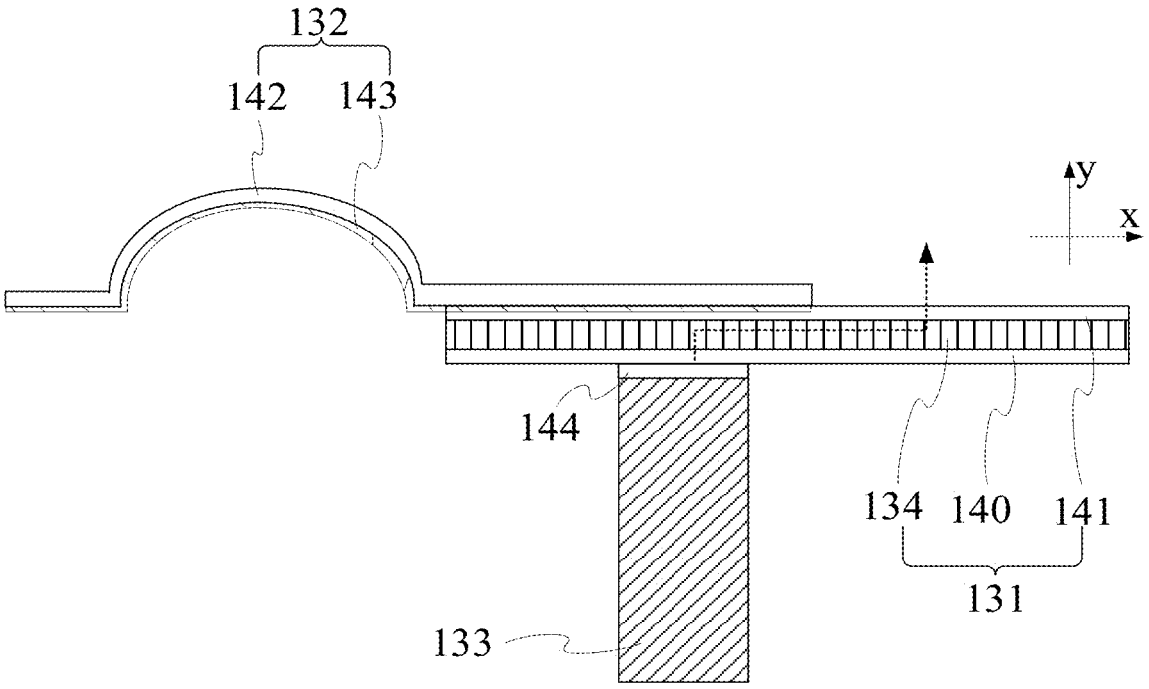
FIG. 10 is a cross-sectional view illustrating a partial structure of a vibration component according to some embodiments of the present disclosure.

In some embodiments, with continued reference to FIG. 10, the voice coil 133 may be opposite to the heat insulation layer 143. That is, the voice coil 133 may be opposite to the heat insulation layer 143 in the y-axis direction. In this way, the heat generated from the voice coil 133, when transferred in the longitudinal direction, is directly blocked by the heat insulation layer 143, which enables most of the heat generated from the voice coil 133 to be transferred in the transverse direction through the dome 131, then transferred in the longitudinal direction in the area of the dome 131 that is not covered by the diaphragm 132 and dissipated outward.

In some embodiments, the heat insulation layer 143 may cover a portion of a side of the diaphragm body 142 facing the dome 131. In other words, a portion of the side of the diaphragm body 142 facing the dome 131 may be covered by the heat insulation layer 143. In this way, the heat insulation layer 143 may have a heat insulation and protection effect on a portion of the diaphragm body 142.

In some embodiments, with continued reference to FIG. 10, the heat insulation layer 143 may cover all of the side of the diaphragm body 142 facing the dome 131. In other words, the heat insulation layer 143 may completely cover the side of the diaphragm body 142 facing the dome 131. This may effectively prevent the heat generated from the voice coil 133 from being transferred to the diaphragm body 142 along a side edge of the dome 131 or via air to affect the vibration performance of the diaphragm 132.

In some embodiments, with continued reference to FIG. 10, a heat-conduction adhesive layer 144 may be provided between the voice coil 133 and the dome 131. In this way, it is more beneficial to transfer the heat generated from the voice coil 133 to the dome 131 to dissipate the heat through the dome 131, reducing the heat accumulated in the sound cavity where the voice coil 133 is located.

The heat dissipation effect of the dome 131 according to the embodiments of the present disclosure will be described below in conjunction with Example 1 and Comparative Example for a clearer understanding thereof

Example 1

Example 1 provides a speaker 120 including a vibration component 130, a magnetic circuit component 150 and a bracket 160. With reference to FIG. 10, the vibration component 130 includes a dome 131, a diaphragm 132 and a voice coil 133. The diaphragm 132 has an annular structure, and the dome 131 is provided in the middle of the diaphragm 132. The diaphragm 132 covers the dome 131, and the voice coil 133 is connected with a side of the dome 131 facing away from the diaphragm 132. The dome 131 includes a porous heat dissipation layer 134 made of foamed copper, and a first aluminum foil and a second aluminum foil respectively provided on two opposite heat dissipation surfaces of the porous heat dissipation layer 134. A heat insulation layer 143 is coated on a side of the diaphragm 132 facing the dome 131 or the voice coil 133.

Comparative Example

The Comparative Example provides a speaker including a vibration component, a magnetic circuit component and a bracket. The vibration component includes a dome, a diaphragm and a voice coil. The speaker according to the Comparative Example differs from that according to the Example 1 at least in: the structural composition of the dome (the dome used in the Comparative Example includes a foamed polymer layer), the diaphragm being provided between the dome and the voice coil, the diaphragm being in direct contact with the voice coil, and no heat insulation layer being coated on the side of the diaphragm facing the voice coil.

Figure 11:
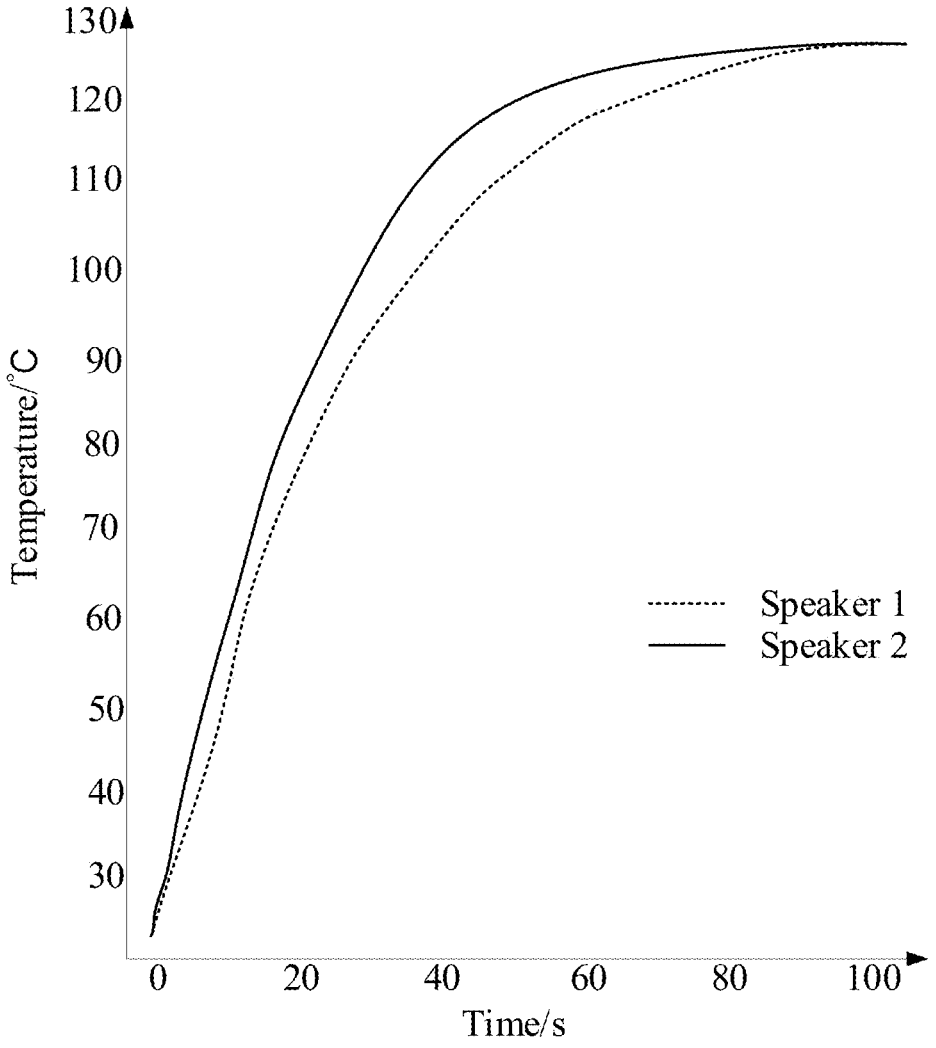
FIG. 11 is a graph illustrating a relationship between a temperature and a time of a voice coil in a speaker according to Example 1 and a voice coil in a speaker according to Comparative Example.

The speaker according to the Example 1 and the speaker according to the Comparative Example were numbered as Speaker 1 and Speaker 2, respectively. Speaker 1 and Speaker 2 were placed in the same enclosed environment, and the voice coil of Speaker 1 and the voice coil of Speaker 2 were controlled to operate at the same power, to obtain a graph illustrating a relationship between an operating time and a temperature of the voice coil of Speaker 1 and the voice coil of Speaker 2. Reference may be made to FIG. 11, which is a graph illustrating a relationship between a temperature and a time of the voice coil in the speaker according to Example 1 and the voice coil in the speaker according to Comparative Example. It can be seen from FIG. 11 that the temperature of the voice coil of Speaker 1 is lower than that of the voice coil of Speaker 2 over time, and the temperature of the voice coil of Speaker 1 is about 10° C. lower than the temperature of the voice coil of Speaker 2 at about 30-60 s (seconds), which is beneficial to the normal operation of Speaker 1. Since Speaker 1 and Speaker 2 are both in the enclosed environment, the final temperatures of the two achieve a balance. Based on this, it can be seen that the vibration component and the speaker according to the embodiments of the present disclosure have a good heat dissipation function.

As above, in the vibration component 130, the speaker 120 and the electronic device 100 according to the embodiments of the present disclosure, the dome 131 of the vibration component 130 includes the porous heat dissipation layer 134, which gives the dome 131 a good heat dissipation capability. By connecting the voice coil 133 with the side of the dome 131 facing away from the diaphragm 132, the heat generated from the voice coil 133 can be directly transferred to the dome 131, reducing heat transfer through the diaphragm 132. In some embodiments, the first support layer 140 may cooperate with the porous heat dissipation layer 134, or the first support layer 140 and the second support layer 141 may cooperate with the porous heat dissipation layer 134, which not only gives the dome 131 a good heat dissipation capability, but also gives the dome 131 a good mechanical strength, so as to avoid split vibration of the diaphragm 132.

In some embodiments, a portion of the diaphragm 132 covers a portion of the dome 131, which is beneficial to reduce the weight of the vibration component 130 and the speaker 120, and also facilitates heat dissipation from the area of the dome 131 that is not covered by the diaphragm 132. In some embodiments, the heat insulation layer 143 may be provided between the diaphragm body 142 and the dome 131 to block the heat transferred to the dome 131 from the voice coil 133, so that the heat may be transferred in the transverse direction in the dome 131 and finally dissipated through the area of the dome 131 that is not covered by the diaphragm 132, which may prevent the heat from affecting the vibration performance of the diaphragm 132 and facilitate heat dissipation from the vibration component 130 and the speaker 120. The speaker 120 has a good heat dissipation performance, and can ensure power and sound quality after operation for a long time, which gives the electronic device 100 including the speaker 120 a good acoustic performance.

Various embodiments of the present disclosure can have one or more of the following advantages.

The dome includes a porous heat dissipation layer, which gives the dome a good heat dissipation performance. By connecting the voice coil with the side of the dome facing away from the diaphragm, the heat generated from the voice coil can be directly transferred to the dome, reducing heat transfer through the diaphragm. By making the diaphragm partially cover a portion of the surface of the dome, the heat generated from the voice coil can be dissipated through the area of the dome that is not covered by the diaphragm, which effectively solves the heat dissipation problem of the vibration component and ensures the normal operation of the voice coil and the diaphragm, and in turn facilitates the vibration component and the speaker to operate for a long time, ensuring the sound effect of the electronic device and improving the user experience.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

What is claimed is:

1. A vibration component, comprising:

a dome comprising a porous heat dissipation layer;

a diaphragm partially covering a portion of a surface of the dome; and a voice coil connected with a side of the dome facing away from the diaphragm, wherein by connecting the voice coil with the side of the dome facing away from the diaphragm, heat generated from the voice coil is transferred directly to the dome, thereby reducing heat transfer through the diaphragm; and by having the diaphragm partially cover a portion of the surface of the dome, the heat generated form the voice coil is dissipated through an area of the dome that is not covered by the diaphragm, thereby improving heat dissipation of the vibration component and ensuring normal operation of the voice coil and the diaphragm.

2. The vibration component of claim 1, wherein the porous heat dissipation layer comprises a first heat dissipation surface and a second heat dissipation surface opposite to the first heat dissipation surface, and the second heat dissipation surface is closer to the voice coil than the first heat dissipation surface;

the porous heat dissipation layer comprises a first heat dissipation hole, a second heat dissipation hole, and a third heat dissipation hole that are alternately connected, the first heat dissipation hole is connected to the first heat dissipation surface, the second heat dissipation hole is connected to the second heat dissipation surface, the third heat dissipation hole is arranged transversely, and the third heat dissipation hole is connected between the first heat dissipation hole and the second heat dissipation hole.

3. The vibration component of claim 1, wherein the porous heat dissipation layer comprises a foamed metal material.

4. The vibration component of claim 3, wherein the dome further comprises a first support layer provided between the porous heat dissipation layer and the voice coil to support the porous heat dissipation layer.

5. The vibration component of claim 4, wherein the dome further comprises a second support layer provided on a side of the porous heat dissipation layer facing away from the first support layer to support the porous heat dissipation layer in corporation with the first support layer.

6. The vibration component of claim 5, wherein the first support layer comprises a first metal layer; and/or the second support layer comprises a second metal layer.

7. The vibration component of claim 1, wherein the diaphragm comprises a diaphragm body and a heat insulation layer provided between the diaphragm body and the dome.

8. The vibration component of claim 7, wherein the heat insulation layer covers a portion or all of a side of the diaphragm body facing the dome.

9. The vibration component of claim 1, wherein a heat-conduction adhesive layer is provided between the voice coil and the dome.

10. A speaker, comprising a vibration component, wherein the vibration component comprises:

a dome comprising a porous heat dissipation layer;

a diaphragm partially covering a portion of a surface of the dome; and a voice coil connected with a side of the dome facing away from the diaphragm, wherein by connecting the voice coil with the side of the dome facing away from the diaphragm, heat generated from the voice coil is transferred directly to the dome, thereby reducing heat transfer through the diaphragm; and by having the diaphragm partially cover a portion of the surface of the dome, the heat generated from the voice coil is dissipated through an area of the dome that is not covered by the diaphragm, thereby improving heat dissipation of the vibration component and ensuring normal operation of the voice coil and the diaphragm.

11. The speaker of claim 10, wherein the porous heat dissipation layer comprises a first heat dissipation surface and a second heat dissipation surface opposite to the first heat dissipation surface, and the second heat dissipation surface is closer to the voice coil than the first heat dissipation surface;

the porous heat dissipation layer comprises a first heat dissipation hole, a second heat dissipation hole, and a third heat dissipation hole that are alternately connected, the first heat dissipation hole is connected to the first heat dissipation surface, the second heat dissipation hole is connected to the second heat dissipation surface, the third heat dissipation hole is arranged transversely, and the third heat dissipation hole is connected between the first heat dissipation hole and the second heat dissipation hole.

12. The speaker of claim 10, wherein the porous heat dissipation layer comprises a foamed metal material.

13. The speaker of claim 12, wherein the dome further comprises a first support layer provided between the porous heat dissipation layer and the voice coil to support the porous heat dissipation layer.

14. The speaker of claim 13, wherein the dome further comprises a second support layer provided on a side of the porous heat dissipation layer facing away from the first support layer to support the porous heat dissipation layer in corporation with the first support layer.

15. The speaker of claim 14, wherein the first support layer comprises a first metal layer; and/or the second support layer comprises a second metal layer.

16. The speaker of claim 10, wherein the diaphragm comprises a diaphragm body and a heat insulation layer provided between the diaphragm body and the dome.

17. The speaker of claim 16, wherein the heat insulation layer covers a portion or all of a side of the diaphragm body facing the dome.

18. The speaker of claim 10, wherein a heat-conduction adhesive layer is provided between the voice coil and the dome.

19. An electronic device, comprising the speaker of claim 10, and further comprising a display panel.

* * * * *